US010710154B2

(12) United States Patent
Breneman et al.

(10) Patent No.: US 10,710,154 B2
(45) Date of Patent: Jul. 14, 2020

(54) CASTING CORE REMOVAL THROUGH THERMAL CYCLING

(71) Applicant: United Technologies Corporation, Farmington, CT (US)

(72) Inventors: Ryan C. Breneman, West Hartford, CT (US); John E. Holowczak, South Windsor, CT (US); John J. Marcin, Marlborough, CT (US); Ingrid H. Kerscht, West Hartford, CT (US); Steven J. Bullied, Pomfret Center, CT (US); Dustin W. Davis, Marlborough, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 15/916,905

(22) Filed: Mar. 9, 2018

(65) Prior Publication Data

US 2019/0275583 A1 Sep. 12, 2019

(51) Int. Cl.
*B22D 29/00* (2006.01)
*B22C 9/02* (2006.01)

(52) U.S. Cl.
CPC ..... *B22D 29/003* (2013.01); *B22C 9/02* (2013.01); *B22D 29/002* (2013.01)

(58) Field of Classification Search
CPC .... B22D 29/00; B22D 29/001; B22D 29/002; B22D 29/003
USPC ..... 164/132, 345
See application file for complete search history.

(56) References Cited

U.S. PATENT DOCUMENTS

| | | | | |
|---|---|---|---|---|
| 3,540,519 | A | 11/1970 | Yates | |
| 4,043,381 | A | 8/1977 | Mazdiyasni et al. | |
| 4,548,256 | A | 10/1985 | Glinn et al. | |
| 5,720,431 | A | 2/1998 | Sellers et al. | |
| 7,240,718 | B2 | 7/2007 | Schmidt et al. | |
| 9,808,862 | B2 | 11/2017 | Verner et al. | |
| 2004/0003909 | A1 | 1/2004 | Schlienger et al. | |
| 2005/0258577 | A1 | 11/2005 | Holowczak et al. | |
| 2007/0095501 | A1* | 5/2007 | Beals et al. | B22D 29/002 164/519 |
| 2007/0181278 | A1* | 8/2007 | Bancheri et al. | B22D 29/002 164/132 |
| 2011/0048172 | A1* | 3/2011 | Schlienger et al. | B22D 29/002 75/375 |
| 2012/0291983 | A1* | 11/2012 | Graham et al. | B22C 9/04 164/516 |
| 2015/0174653 | A1* | 6/2015 | Verner et al. | B22D 29/002 164/132 |

(Continued)

OTHER PUBLICATIONS

EP search report for EP19161752.1 dated Apr. 25, 2019.

*Primary Examiner* — Kevin P Kerns
(74) *Attorney, Agent, or Firm* — Getz Balich LLC

(57) ABSTRACT

A method of removing a core of a cast component includes providing a casting that includes a silica based ceramic core in a temperature controlled closed volume; cycling temperature between a first temperature and a second temperature within the temperature controlled closed volume that repeatedly subjects the silica based ceramic core to a beta-to-alpha cristobalite transition that induces microfractures in the silica based ceramic core; and after the cycling temperature, chemically dissolving the silica based ceramic core from the casting.

15 Claims, 4 Drawing Sheets

(56) References Cited

U.S. PATENT DOCUMENTS

2016/0175923 A1* 6/2016 Liu et al. ..... B22C 9/04
164/271

* cited by examiner

CASTING CORE REMOVAL THROUGH THERMAL CYCLING

BACKGROUND OF THE INVENTION

1. Technical Field

The present disclosure relates to casting metal components, more particularly to removal/dissolution of core material used to form passageways in a casted metal component.

2. Background Information

Hollow castings are widely used to produce gas turbine engine components. Gas turbine components are often cooled by flowing air through internal cavities. However, the use of cooling air, which is supplied from the compressor section of the engine, reduces operating efficiency. Consequently there is a desire to maximize the cooling effect of compressor cooling air to improve efficiency. Increasing cooling efficiency usually requires more complex internal passages. Gas turbine engine designers have devised many airfoil designs for improving cooling efficiency, however some of these designs have proven difficult to produce on a cost-efficient basis.

FIG. 1A illustrates a cross-section through a prior art airfoil of the type disclosed in U.S. Pat. No. 5,720,431. FIG. 1B illustrates a cross-section through a prior art core used to fabricate the air foil illustrated in FIG. 1A. FIG. 1C illustrates a cross-section through a core as shown in FIG. 1B along with a surrounding prior art integral shell mold. Referring to FIG. 1A, airfoil 40 has a leading edge 42, a trailing edge 44, a pressure surface 46 and a suction surface 48. The airfoil 40 has an outer wall 50 and an inner wall 52, which are generally parallel and relatively uniformly spaced apart. The outer wall 50 is connected to the inner wall 52 by multiple spacers 54. The outer wall 50, inner wall 52, and spacers 54 cooperate to form a stiff structure. The outer wall 50, inner wall 52, and spacers 54 also cooperate to form a plurality of channels 58 which are connected to a central supply cavity 56. The central supply cavity 56 is in fluid connection with each channel 58 by multiple apertures 60. Enhanced cooling is provided by flowing pressurized cooling fluid into the supply cavity 56, and then through the cooling holes 60. Air flowing through the cooling holes 60 impinges on the inner surface 62 of the outer wall 50 and cools the wall 50. The cooling air then flows through multiple holes (not shown) in the outer wall 50 to provide film cooling of the outer surface 64 of the outer wall 50. In addition, the double wall construction provides strength and stiffness to the airfoil.

The fabrication of an airfoil such as that shown in FIG. 1A by casting requires a complex core to form the interior features of the airfoil. Such a complex core is illustrated in FIG. 1B. Core 70 includes an inner ceramic element 72 whose outer surface 74 corresponds generally to the inner surface of the supply cavity 56 in FIG. 1A. The ceramic element 72 is connected to multiple elements 76 which correspond to the supply channels 58 by elements 78 which correspond to the cooling holes 60 in FIG. 1A.

FIG. 1C shows the core assembly 70 of FIG. 1B surrounded by a ceramic mold 80, the combination of the core 70 and the mold 80 produce a complex cavity arrangement 81. The cavity 81 corresponds in shape to the airfoil of FIG. 1A.

The core 70 must be removed from the casting, and that is generally done using a caustic solution. Typically the cores 70 are produced from silica based ceramics and leached via a caustic chemical process. This caustic core removal can be time consuming and verifying full removal of the complex casting core can be difficult. Increasing complexity and fine channel size in advanced turbine components can result in increased difficulty of core removal.

There is a need for an improved method of removal/dissolution of casting cores.

SUMMARY OF THE DISCLOSURE

The following presents a simplified summary in order to provide a basic understanding of some aspects of the disclosure. The summary is not an extensive overview of the disclosure. It is neither intended to identify key or critical elements of the disclosure nor to delineate the scope of the disclosure. The following summary merely presents some concepts of the disclosure in a simplified form as a prelude to the description below.

Aspects of the disclosure are directed to a method of removing a core of a cast component, comprising providing a casting that includes a silica based ceramic core in a temperature controlled closed volume; cycling temperature between a first temperature and a second temperature within the temperature controlled closed volume that repeatedly subjects the silica based ceramic core to a beta-to-alpha cristobalite transition that induces microfractures in the silica based ceramic core; and after the cycling temperature, chemically dissolving the silica based ceramic core from the casting.

The temperature controlled closed volume may comprise at least one of an autoclave, a gas fired kiln or a resistively heated furnace box.

The temperature controlled closed volume may comprise a temperature controlled closed pressure volume.

The first temperature may be about 175 degrees C. and the second temperature may be about 300 degrees C.

The first temperature may be less than 200 degrees C. and the second temperature may be at east 275 degrees C.

According to another aspect of the present disclosure, a method of removing a core of an airfoil cast component comprises inserting the airfoil cast component, which includes a silica based ceramic core, into a temperature controlled vessel; cycling temperature, within the temperature controlled vessel, between a first temperature and a second temperature a plurality of times that repeatedly subjects the silica base ceramic core to transitions that induce microfractures in the silica based ceramic core; and after the cycling temperature, chemically dissolving the silica based ceramic core from the casting.

The temperature controlled vessel may comprise an autoclave.

The first temperature may be less than 200 degrees C. and the second temperature may be at least 275 degrees C.

The plurality of times may be at five.

The plurality of times may be at least ten.

The repeatedly cycling between the second temperature, where the core is transitioned to beta cristobalite phase and the first temperature where the core is transitioned to alpha cristobalite phase, repeatedly subjects the core to beta-to-alpha transitions that induce the fractures in the core.

DETAILED DESCRIPTION

Figure 1A:
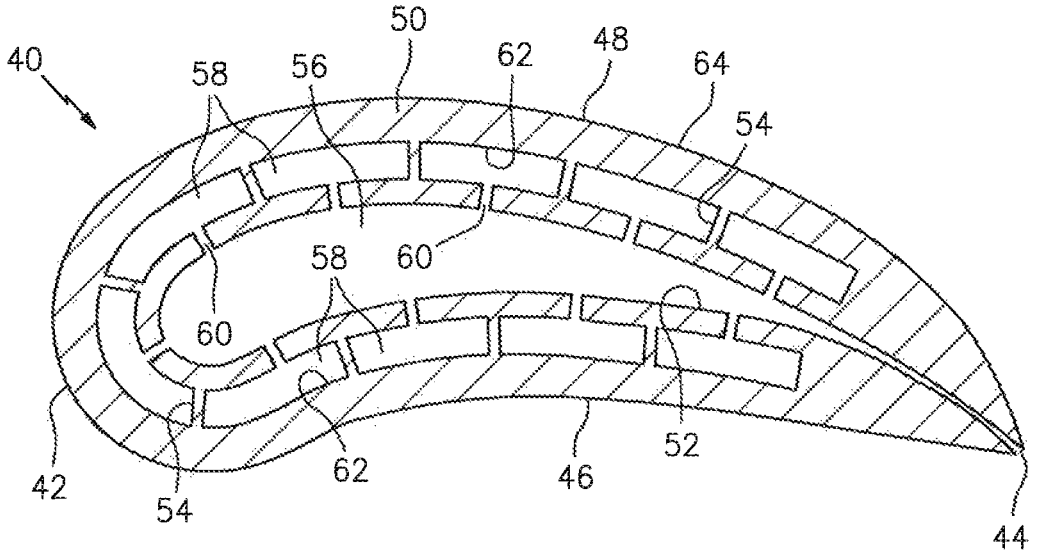
FIG. 1A (PRIOR ART)
FIG. 1A illustrates a cross-section through a prior art airfoil.

It is noted that various connections and steps are set forth between elements in the following description and in the drawings (the contents of which are incorporated in this specification by way of reference). It is noted that these connections and steps are general and, unless specified otherwise, may be direct or indirect and that this specification is not intended to be limiting in this respect. A coupling between two or more entities may refer to a direct connection or an indirect connection. An indirect connection may incorporate one or more intervening entities or a space/gap between the entities that are being coupled to one another.

Aspects of the disclosure may be applied in connection with a gas turbine engine.

Figure 1B:
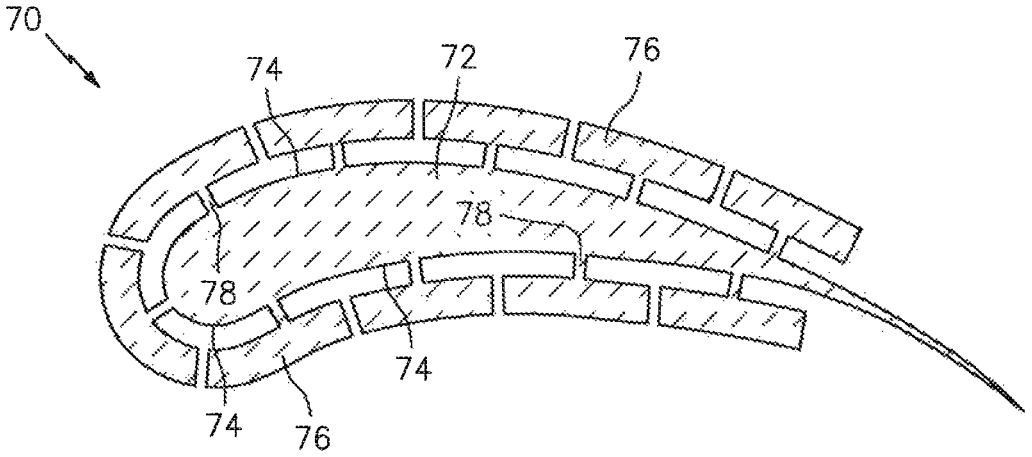
FIG. 1B (PRIOR ART)
FIG. 1B illustrates a cross-section through a prior art core used to fabricate the airfoil illustrated in FIG. 1A.
Figure 2:
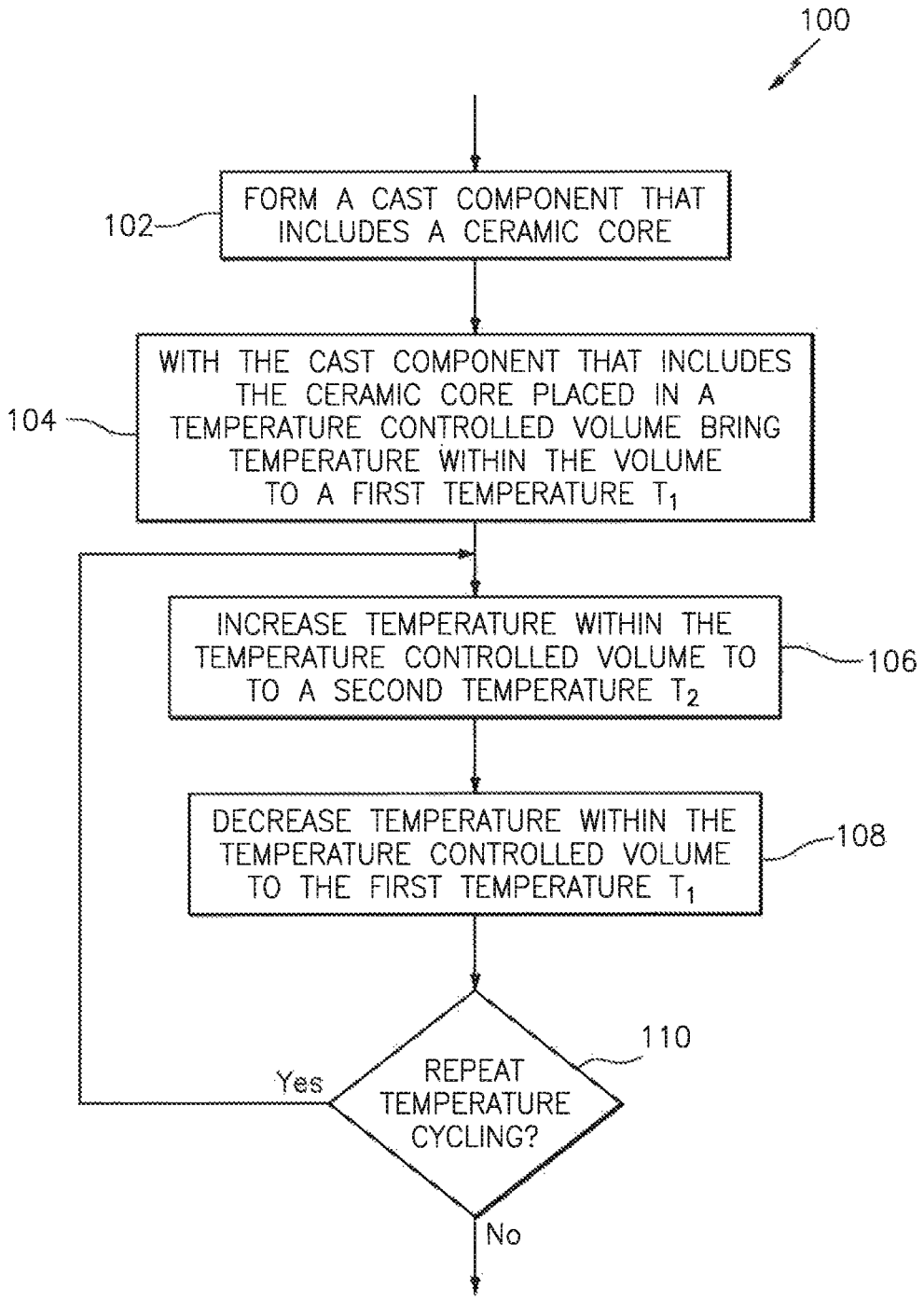
FIG. 2 illustrates an exemplary method for removal/dissolution of the casting core.

FIG. 2 illustrates an exemplary method 100 for removal/dissolution of casting cores, for example during the manufacturing of an airfoil such as a gas turbine engine turbine blade, U.S. Patent Application Publication No. 2005/0258577 entitled "Method of Producing Unitary Multi-Element Ceramic Casting Cores and Integral Core/Shell System", assigned to the assignee of the present application, is hereby incorporated by reference. The method 100 includes a step 102 of forming a cast component (e.g., an airfoil such as a turbine blade) that includes a ceramic core. The component may be the core assembly 70 illustrated in FIG. 1B surrounded by the ceramic mold 80, where the shape of the cavity 81 corresponds to the airfoil illustrated in FIG. 1A.

Figure 1C:
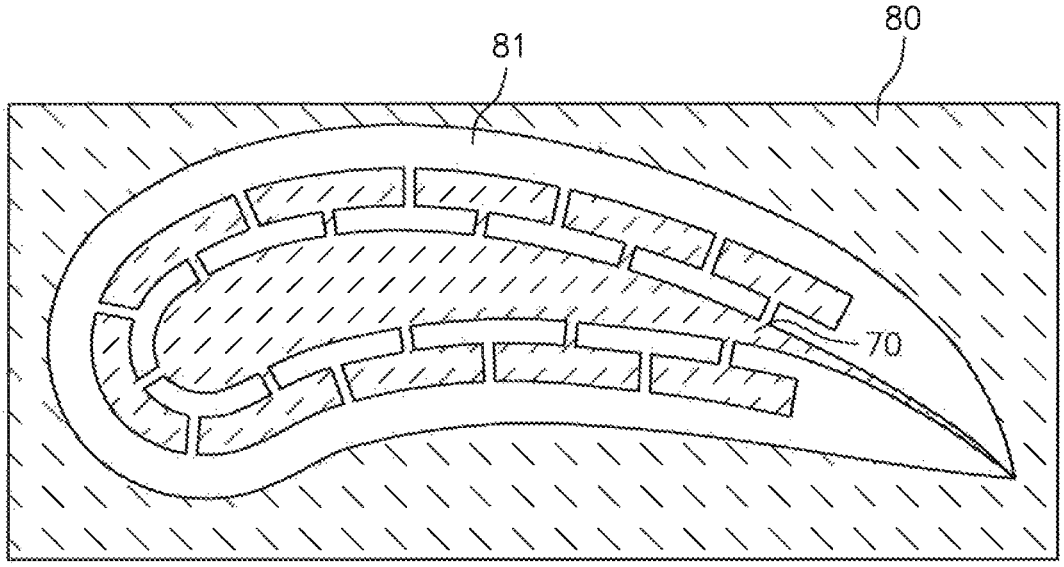
FIG. 1C (PRIOR ART)
FIG. 1C illustrates a cross-section through a casting core as shown in FIG. 1B along with a surrounding prior art integral shell mold.
Figure 3:
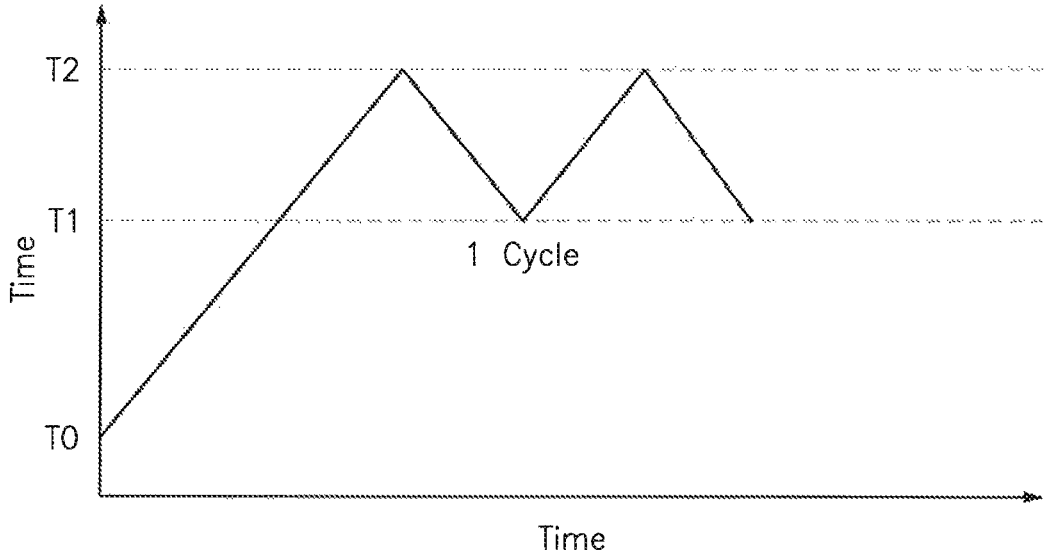
FIG. 3 is a plot of temperature versus time associated with the exemplary method illustrated in FIG. 2.

Step 102 includes forming a cast component that includes a ceramic core. Silica based cores undergo a phase transformation during the casting process from amorphous silica to the crystalline phase cristobalite. Subsequent to this phase transformation, in step 104 the cast component (FIG. 1C) containing the core 70 (FIG. 1C) is placed in a temperature controlled volume (e.g., a heated pressure vessel, an autoclave, gas fired kiln, resistively heated box furnace etc.). The temperature within the volume is brought from ambient temperature $T_0$ to a first temperature $T_1$ (e.g., 175-200 degrees C.). $T_1$ is defined as a temperature such that the equilibrium phase of cristobalite is alpha cristobalite. $T_1$ can be equal to ambient temperature $T_0$; however this is not the preferred method as it requires an inefficiently wide transition range. In step 106 the temperature is then increased to a second temperature $T_2$ (e.g., 275-300 degrees C.). $T_2$ is defined as a temperature such that the equilibrium phase of cristobalite is beta cristobalite. The heating from ambient temperature $T_0$ to $T_2$ can be done continuously and does not require a dwell at $T_1$. As $T_2$ is higher than $T_1$ the temperature will inherently pass $T_1$ on heating from $T_0$ to $T_2$. FIG. 3 illustrates a plot of temperature versus time of the temperature cycling illustrated in FIG. 2. In step 108 the temperature within the volume is then decreased to the first temperature $T_1$. A pyrometer may be used to monitor the surface temperature of the cast component. The decrease in temperature from the second temperature $T_2$ to the first temperature $T_1$ induces fractures in the ceramic core because of the volume change caused by the temperature change. Cristobalite undergoes a displacive phase transformation on cooling between the second temperature $T_2$ and the first temperature $T_1$. This beta-to-alpha cristobalite transition is accompanied by approximately a 4% volume change. Repeated thermally cycling between $T_2$ and $T_1$ subjects the casting core material 70 (FIGS. 1B and 1C) to repeated beta-to-alpha transitions that induce fractures in the casting core from the volume change. This micro fracturing of the core accelerates core removal/dissolution by caustic attack by opening paths in the core for caustic infiltration, thus reducing the time for core removal/dissolution.

The process of repeatedly increasing and decreasing the temperature within the volume as set forth in steps 106 and 108 may be repeated a number of times (e.g., 2-20 times) to induce fractures from the volume change. Step 110 asks if the temperature cycling should be repeated. If yes, then the method 100 returns to step 106 to increase temperature in the vessel to the second temperature $T_2$. Once the process of repeatedly increasing and decreasing the temperature within the volume has been performed the desired number of times and step 110 determines the cycling does not need to be repeated, then the method 100 terminates and proceeds to chemically remove/dissolve the core. The test performed in step 100 may use a simple counter based upon the number of times the steps 106 and 108 have been performed in succession. Alternatively, visual assessment of the cast component may be made to determine if the silica core has largely been reduced from solid ceramic to loose powder. Alternatively, parts may be rotated or agitated after each cycle and progress may monitored by mass loss from loose core material falling from the casting.

The fracturing caused by the repeated cycling of temperature set forth in step 106 and 108 helps to reduce the amount of time required to chemically remove/dissolve the core.

In one exemplary method, an oven was heated to 650 degrees F. (343 degrees C.) and the cast component containing the core was placed in the oven until heated to at least 290 degrees C. The cast component containing the core was removed and allowed to cool. When the temperature on the surface of the cast component was below 190 degrees C. the component was returned to the heated oven and heated to at least 290 degrees C. The heated component was removed again from the oven and allowed to air cool. The process of heating to above 290 degrees C. and then allowing to cool to below 190 degrees C. was performed for ten (10) cycles before caustic core removal.

The higher and lower temperature bound can be varied significantly so long as the upper temperature, $T_0$, results in the core predominantly transitioning to the beta cristobalite phase and the lower temperature, $T_1$, results in the core predominantly transitioning to the alpha cristobalite phase. The exact temperatures will be dependent on the precise core formulation and thermal history. The beta-to-alpha cristobalite transition temperature may vary over a wide range (e.g., 200-250 degrees C.) depending on impurity content and thermal history of the base silica material. Any selection of $T_2$ above this transition point and $T_1$ below this transition point would be effective.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed in the illustrated embodiment, other arrangements will benefit herefrom.

The foregoing description is exemplary rather than defined by the features within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A method of removing a core of a cast component, comprising:

providing a casting in a temperature controlled closed volume, the casting surrounding a silica based ceramic core;

cycling temperature between a first temperature and a second temperature within the temperature controlled closed volume that repeatedly subjects the silica based ceramic core to a beta-to-alpha cristobalite transition that induces microfractures in the silica based ceramic core; and after the cycling temperature, in a volume different than the temperature controlled closed volume, chemically dissolving the silica based ceramic core from the casting.

2. The method of claim 1 where the temperature controlled closed volume comprises at least one of an autoclave, a gas fired kiln, or a resistively heated furnace box.

3. The method of claim 1 where the temperature controlled closed volume comprises a temperature controlled closed pressure volume.

4. The method of claim 1, where the first temperature is 175 degrees C. and the second temperature is 300 degrees C.

5. The method of claim 1, where the first temperature is less than 200 degrees C. and the second temperature is at least 275 degrees C.

6. The method of claim 1, wherein the cycling comprises repeatedly increasing the temperature within the temperature controlled closed volume from the first temperature to the second temperature and lowering the temperature within the temperature controlled closed volume from the second temperature to the first temperature.

7. A method of removing a core of an airfoil cast component, comprising:

inserting the airfoil cast component, which includes a silica based ceramic core embedded within the airfoil cast component, into a temperature controlled vessel;

cycling temperature, within the temperature controlled vessel, between a first temperature and a second temperature a plurality of times that repeatedly subjects the silica based ceramic core to at least one phase transition that induces microfractures in the silica based ceramic core; and after the cycling temperature, in a vessel different than the temperature controlled vessel, chemically dissolving the silica based ceramic core from the airfoil cast component.

8. The method of claim 7, where the temperature controlled vessel comprises an autoclave.

9. The method of claim 7, where the first temperature is less than 200 degrees C. and the second temperature is at least 275 degrees C.

10. The method of claim 9, where the plurality of times is at least five.

11. The method of claim 10, where repeatedly cycling between the second temperature, where the core is transitioned to beta cristobalite phase, and the first temperature, where the core is transitioned to alpha cristobalite phase, repeatedly subjects the core to beta-to-alpha transitions that induce the microfractures in the core.

12. The method of claim 9, where the plurality of times is at least ten.

13. The method of claim 7, wherein the cycling comprises repeatedly raising the temperature within the temperature controlled vessel from the first temperature to the second temperature and then lowering the temperature within the temperature controlled vessel from the second temperature to the first temperature.

14. The method of claim 7, wherein the cycling comprises raising the temperature within the temperature controlled vessel from the first temperature to the second temperature and then lowering the temperature within the temperature controlled vessel from the second temperature to the first temperature; and again raising the temperature within the temperature controlled vessel from the first temperature to the second temperature and then lowering the temperature within the temperature controlled vessel from the second temperature to the first temperature.

15. A method of removing a silica-based ceramic core, the method comprising:

disposing a casting within a vessel, wherein the silica-based ceramic core is within and surrounded by the casting;

increasing a temperature within the vessel from a first temperature to a second temperature to increase a temperature of the silica-based ceramic core for a first heating iteration;

decreasing the temperature within the vessel from the second temperature to the first temperature to decrease the temperature of the silica-based ceramic core for a first cooling iteration;

increasing the temperature within the vessel from the first temperature to the second temperature to increase the temperature of the silica-based ceramic core for a second heating iteration;

decreasing the temperature within the vessel from the second temperature to the first temperature to decrease the temperature of the silica-based ceramic core for a second cooling iteration; and after the second cooling iteration, chemically dissolving the silica based ceramic core from within the casting.

* * * * *